US007527244B2

(12) United States Patent
MacPherson

(10) Patent No.: US 7,527,244 B2
(45) Date of Patent: May 5, 2009

(54) WATER WELL SERVING SYSTEM

(76) Inventor: Raynold Gott MacPherson, 1902 SE. 14th St., Cape Coral, FL (US) 33990

( * ) Notice: Subject to any disclaimer, the term of this patent is extended or adjusted under 35 U.S.C. 154(b) by 0 days.

(21) Appl. No.: 11/891,596

(22) Filed: Aug. 13, 2007

(65) Prior Publication Data

US 2009/0045382 A1 Feb. 19, 2009

(51) Int. Cl.
*B66D 1/36* (2006.01)

(52) U.S. Cl. ..... 254/334; 254/335

(58) Field of Classification Search ..... 254/334, 254/335, 362

See application file for complete search history.

(56) References Cited

U.S. PATENT DOCUMENTS 807,861 A * 12/1905 Pennell ..... 254/336
1,114,918 A * 10/1914 Sohlemma ..... 254/334
2,361,053 A * 10/1944 Pedersen et al. ..... 212/307
3,991,978 A * 11/1976 Jones ..... 254/335
4,364,545 A * 12/1982 Kobylinski ..... 254/284
4,497,470 A * 2/1985 Carter et al. ..... 254/134.3 FT
4,597,562 A * 7/1986 Joyce ..... 254/334
4,695,040 A * 9/1987 Hantschk ..... 254/264
5,240,229 A * 8/1993 Timmons ..... 254/338
5,284,324 A * 2/1994 Bunger ..... 254/266
6,193,218 B1 * 2/2001 Philyaw ..... 254/326
6,481,694 B2 * 11/2002 Kozak ..... 254/325
6,490,906 B1 * 12/2002 Bailey ..... 72/457
6,554,254 B2 * 4/2003 Vetesnik ..... 254/325
6,769,669 B2 * 8/2004 Cook et al. ..... 254/329
7,311,297 B1 * 12/2007 Bradshaw et al. ..... 254/272

* cited by examiner

*Primary Examiner*—Emmanuel M Marcelo
(74) *Attorney, Agent, or Firm*—Werner H. Schroeder

(57) ABSTRACT

A system for servicing a water well including a well pipe having a pump and a motor at a bottom thereof. The well head has a platform to support a winch thereon. Also supported on the platform is an upstanding mast having a return wheel at a top thereof. One end of a cable is attached to the winch and another end is attached to a top of the well pipe after having been trained over the return wheel at the top of the mast. Activating the motor on the winch will pull the well pipe from the deep well including the pump and the motor.

3 Claims, 2 Drawing Sheets

WATER WELL SERVING SYSTEM

FIELD OF THE INVENTION

The invention pertains to a service system for deep water wells. Deep water wells have a pump that is lowered into a deep well by way of well pipes that will be instrumental to carry the water above ground once the pump is activated. Shallow wells use suction pumps above ground that will not work with deep water wells because the suction cannot carry that kind of weight of water.

BACKGROUND OF THE INVENTION

As mentioned above, deep water wells have a pump that is lowered into the deep well by way of a well pipe that will carry the pumped water to the ground above. The pump, as well as the pipe, have to be serviced at frequent intervals and the problem is to bring the pipe and thereby the pump above ground to be able to be serviced. Various ways have been established including cables attached to the pump which cable is wound up by a winch, for example. It has been found that this system is very cumbersome and my lead to damage of the well walls as well as to the pipe or the pump.

BRIEF DESCRIPTION OF THE INVENTION

The inventive concept involves a simple platform that is placed at the head of the well and has an upstanding tower thereon. The top of the tower has a return pulley thereon. A cable is trained from the ground over the return pulley and down again to the top of the well pipe. The cable is fastened to the top of the well pipe at one end and another end is fastened to a winch on the platform. Once the winch is operated, the pipe with the pump at the bottom is slowly pulled out of the well.

DETAILED DESCRIPTION OF THE INVENTION

Figure 1:
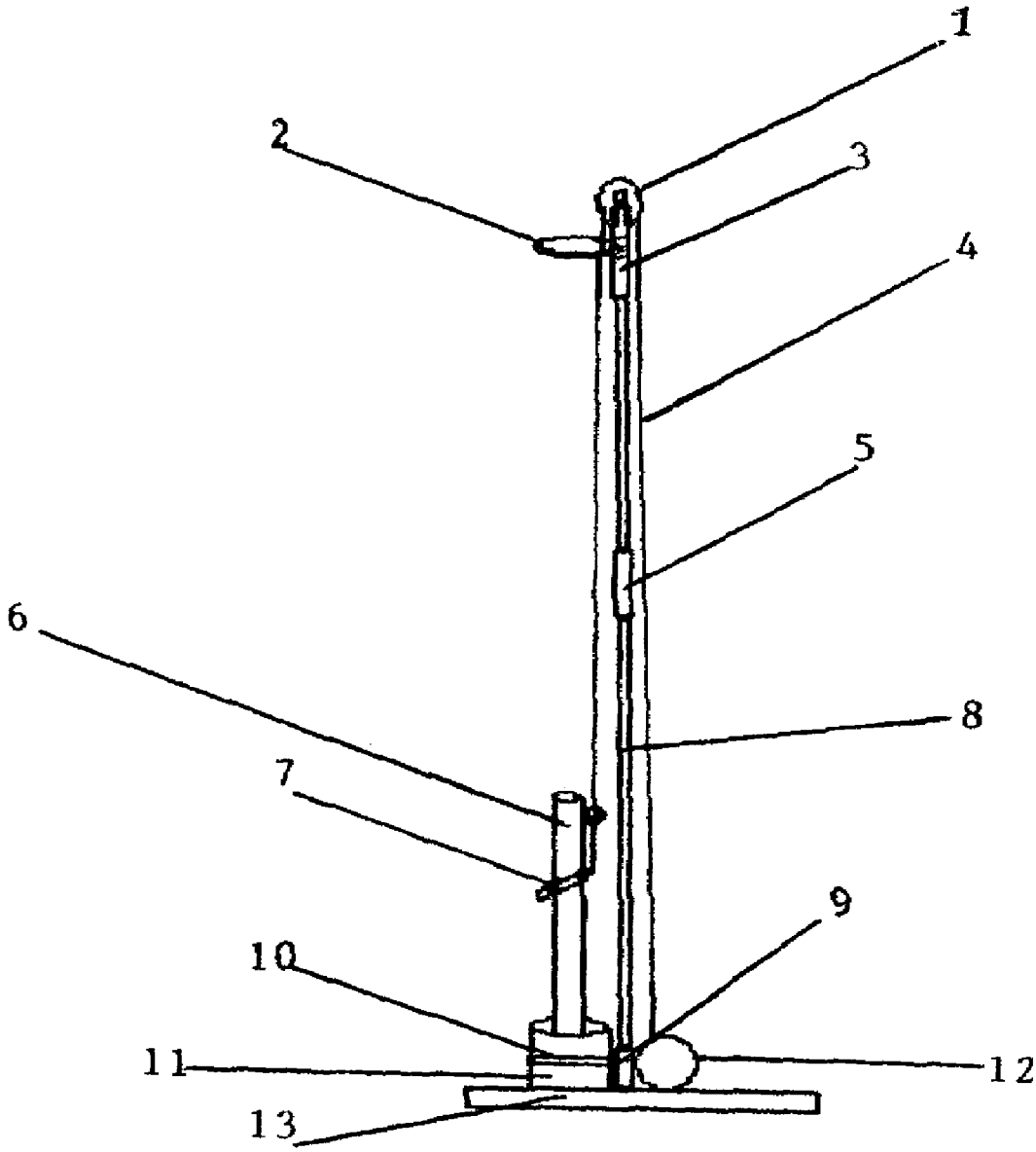
FIG. 1 is a side of the pump puller including attachments.

FIG. 1 illustrates the water well service system including an upstanding tower or mast. The lower part of the mast is shown at 8. Preferably the mast consists of at least two parts which can be connected by a connector or sleeve 5. This is an advantage in that the mast can be transported in several sections. At the top of the mast there is a return wheel 1 which is attached to the mast by way of a sleeve or connector 3. The mast is supported at the bottom by a base neck support and on top of the well head by way of a platform 13. On the platform 13 there is mounted a winch which is driven by an electric motor 12. The motor 12 could be of a twelve Volt type so that the electricity to drive the motor can be derived from the battery of a vehicle serving the well. From the motor there extends a cable 4 upwardly which is trained over the return wheel on top of the mast 8 and then downwardly to a clamp 7 that is attached to the well pipe 6. The well pipe extends into the well casing 11 which has a protective collar 10 attached to its top.

Figure 2:
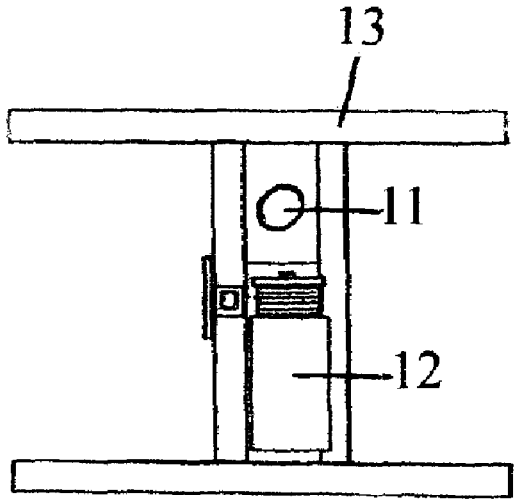
FIG. 2 is a top view of the service platform.

FIG. 2 shows the well head support platform 13 as an H-shape construction, although many other designs could be used. As explained above, the well casing is shown at 11 and the motor and winch at 12.

Figure 3:
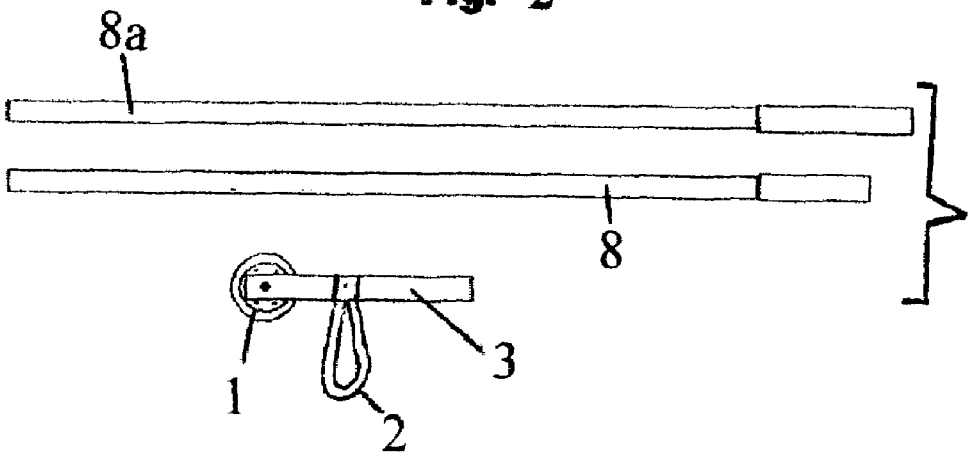
FIG. 3 illustrates the disassembled service tower with attachments.

FIG. 3 shows the individual elements that are used in servicing the well. Numerals 8 and 8*a* show the upstanding mast in two sections. The return wheel 1 is attached to the connecting sleeve 3 which will be mounted on top of the mast as is shown in FIG. 1. The ring or sling 2 which is attached to the sleeve 3 is used as guide when a new well pipe is lowered into the well after service. This sling will hold the well pipe in a vertical position when it is lowered.

Operation

When a deep well has to serviced, such as to replace the pump motor, The platform 13 will be installed over the well head. Next, the mast 8, 8*a* will be installed in an upright position on the platform. Prior to erecting the mast, a cable will be trained over the return wheel 1 with one end attached to the winch 12. Once the mast is erected, the other end of the cable will be attached to the well pipe 6 by way of a clamp 7. The winch can now be started and the well pipe 6 will emerge by being pulled upwardly from the well casing. As a sufficient length of the well pipe has emerged, it can be cut or disconnected from connectors along the length. Finally the pump and the motor will appear at the surface and may now be serviced. To reinstall the pump and the motor the reverse will take place. A length of well pipe will be threaded through the ring or sling 2 at the top of the mast as a vertical guide when the well pipe is lowered into the well casing.

What I claim is:

1. A system to service a pump and motor in a deep well comprising a platform placed at a well head, said platform has an upstanding mast thereon, a return wheel placed at a top of said mast, a winch placed on top of said platform, a cable having one end attached to said winch, said cable is trained around said return wheel, another end of said cable having means thereon for being attached to a top or a well pipe having said pump and motor attached at a bottom thereof, wherein said means for being attached is a cheap and wherein said mast consists of several sections having means thereon for connecting said several sections together.

2. The system of claim 1 including a sling attached to a support for said return wheel to guide said well pipe in a vertical direction.

3. The system of claim 1, wherein said motor is a 120 Volt electric motor.

* * * * *